United States Patent [19]

Noda et al.

[11] 3,938,232

[45] Feb. 17, 1976

[54] METHOD OF MANUFACTURING CATALYST TYPE EXHAUST GAS PURIFIER

[75] Inventors: Fumiyoshi Noda; Mikio Murachi, both of Toyota, Japan

[73] Assignee: Toyota Jidosha Kogyo Kabushiki Kaisha, Toyota, Japan

[22] Filed: Apr. 24, 1974

[21] Appl. No.: 463,583

[30] Foreign Application Priority Data

Apr. 28, 1973 Japan ..... 48-049505

[52] U.S. Cl. ..... 29/157 R; 23/288 FC; 29/428; 29/527.3; 29/530; 156/89; 181/35 C; 181/36 C

[51] Int. Cl.[2] ..... B21D 53/00

[58] Field of Search ..... 29/400, 418, 423, 424, 29/434, 436, 463, 464, 527.1, 527.2, 527.3, 527.5, 530, 157, 447; 138/112; 23/288 FC; 60/299; 156/78, 89

[56] References Cited

UNITED STATES PATENTS

| | | | |
|---|---|---|---|
| 3,248,791 | 5/1966 | Powers | 29/157 R |
| 3,380,810 | 4/1968 | Hamblin | 23/288 FC |
| 3,441,381 | 4/1969 | Keith et al. | 181/62 X |
| 3,441,382 | 4/1969 | Keith et al. | 23/288 FC |
| 3,491,182 | 1/1970 | Hunder et al. | 29/157 R X |
| 3,503,714 | 3/1970 | Lang | 23/288 FB |
| 3,600,142 | 8/1971 | Fessler | 181/36 C X |
| 3,739,443 | 6/1973 | Friedman | 29/447 X |
| 3,771,967 | 11/1973 | Nowak | 23/288 FC |
| 3,798,006 | 3/1974 | Balluff | 23/288 FC |
| 3,801,289 | 4/1974 | Wiley | 23/288 FC |

FOREIGN PATENTS OR APPLICATIONS

| | | | |
|---|---|---|---|
| 962,180 | 7/1964 | United Kingdom | 138/112 |

*Primary Examiner*—C. W. Lanham
*Assistant Examiner*—Joseph A. Walkowski
*Attorney, Agent, or Firm*—Brisebois & Kruger

[57] ABSTRACT

Method of manufacturing a catalyst type exhaust gas purifier utilizing a divisible vessel to hold an integrated catalyst, while a packing is inserted at the junction between the divisible parts. The space between the vessel and the catalyst is filled with a castable refractory material, which is then solidified, after which the packing is removed and then the parts of the vessel are drawn together at said junction.

4 Claims, 3 Drawing Figures

METHOD OF MANUFACTURING CATALYST TYPE EXHAUST GAS PURIFIER

BACKGROUND OF THE INVENTION

An exhaust gas purifier utilizing a catalyst is one of the conventional means for eliminating carbon monoxide, unburnt hydrocarbons and nitrogen oxides which are said to be the most harmful gases contained in the emissions of internal combustion engines.

Among the exhaust gas purifiers of this catalyst type, the most common one holds layers of catalyst pellets, i.e., pellets carrying a metallic catalyst enclosed in a metal casing. The exhaust gas, as it passes through such layers of catalyst pellets, is rendered harmless by chemical reaction.

Another type of exhaust gas purifier uses an integrated catalyst, as illustrated by U.S. Pat. Nos. 3,441,381 and 3,441,382. In this type both ends are open and the purifier holds a metallic catalyst carried by a ceramic carrier with a plurality of internal passages for exhaust gas.

Exhaust gas purifiers of the last-mentioned integrated catalyst type are superior to those of the pellet catalyst type in that the catalyst does not deteriorate as a consequence of abrasion during vibration and the catalyst vessel itself is simplified in structure.

When the integrated catalyst is installed within a cylindrical vessel, however, a space is usually left between the inner wall of the cylindrical vessel and the outer wall of the integrated catalyst under high temperature on account of the wide difference between the rate of thermal expansion of the metallic vessel and that of the integrated catalyst, which is ceramic. Since this space is quite wide, a violent impact occurs between the vessel and the catalyst due to vibrations transmitted from the engine, unless cushioning means is provided between the vessel and the catalyst; and this results in destruction of the integrated catalyst.

To prevent this, according to U.S. Pat. No. 3,441,381, the space between the inner wall of the vessel and the outer wall of the integrated catalyst is filled with metal textile, which serves as a cushioning means; and according to U.S. Pat. No. 3,441,382, the integrated catalyst is held in position by springs with ceramic heat insulation provided between them.

In the case of the above-mentioned metal textile, this textile would make an effective cushioning material if its elasticity were not lost at high temperatures in practical service; but when installed on an automobile with wide variations of load, it is exposed to a temperature of several hundred °C under high load engine operation. At such high temperatures it loses its elasticity and ceases to be effective for cushioning. Consequently the catalyst is often broken.

When springs are used to hold the catalyst in position, the construction is complicated and the manufacture is not easy, resulting in a high cost of manufacture. It is also possible to mount the integrated catalyst in the vessel by shrink-fitting; but this method is not advisable, because it requires high precision in the external dimensions of catalyst and the internal dimensions of vessel, resulting in a poor yield and a very high cost.

SUMMARY OF THE INVENTION

The primary object of the present invention is to provide a method of manufacturing a catalyst type exhaust gas purifier which is free from the drawbacks of conventional devices and can reliably hold the integrated catalyst in position even at high temperatures in practical service. Basically the method of the present invention comprises the steps of charging a fluid castable refractory into the space between the inner wall of vessel and the outer wall of integrated catalyst; drying and firing said refractory; and then tightening the vessel, thereby to hold the catalyst in a shrink-fit state. This method increases the durability of the catalyst greatly because, even at high temperatures no gap is likely to develop between the catalyst and the vessel and the catalyst can be held in position. Moreover, said castable refractory, if appropriately selected, can remain stable even under gas temperatures exceeding 1000°C; and its high heat insulating ability will improve the heat insulating performance of the catalyst type exhaust gas purifier.

Other objects of the present invention will become apparent from the following description of a preferred embodiment of the present invention.

DETAILED DESCRIPTION OF THE INVENTION

Figure 1:
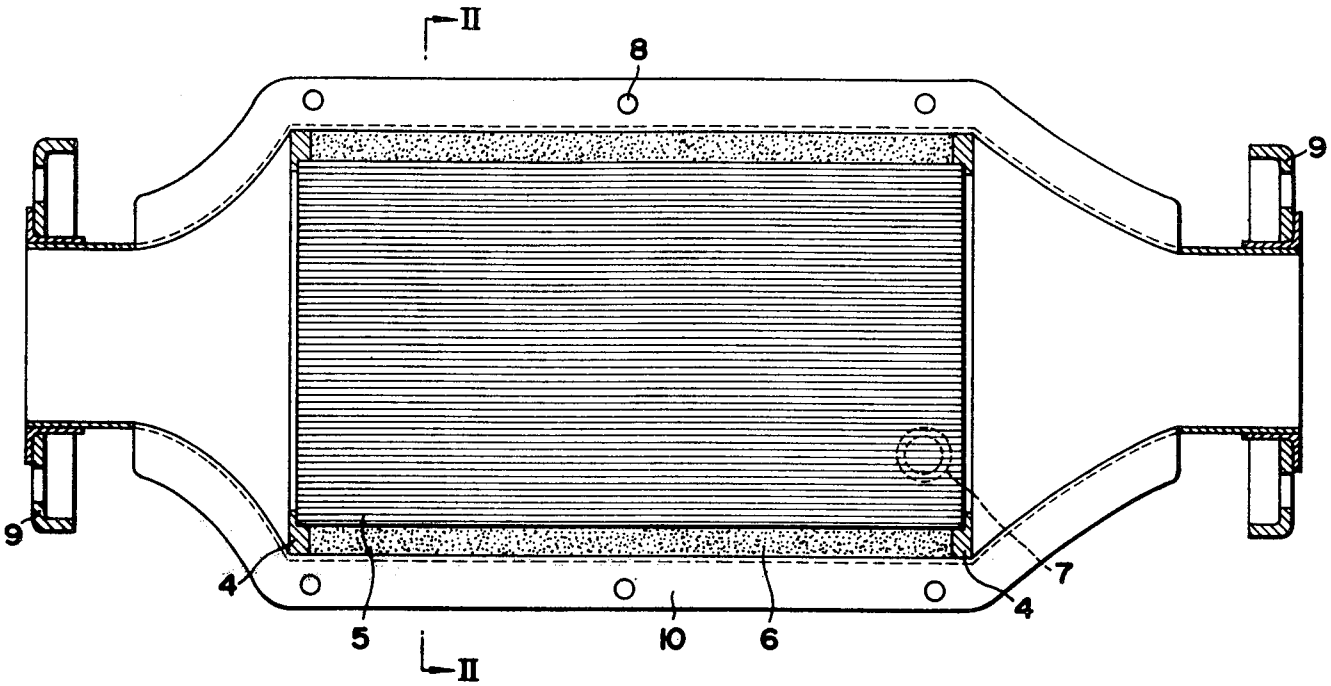
FIG. 1 is a longitudinal section view of an exhaust gas purifier according to the present invention.
Figure 2:
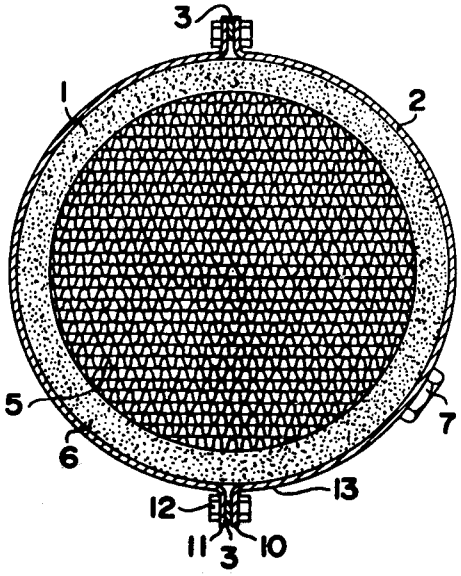
FIG. 2 is a section view taken along the line II— II of FIG. 1.

As illustrated in FIGS. 1 and 2, a vessel divisible into parts 1 and 2 is used. First, the integrated catalyst 5 is fitted to the centering plate 4, which is then fixed to the part 2 of said vessel. Packing 3 is provided at the junction between parts 1 and 2 of the vessel and these parts are connected together by a bolt 12 and a nut 13. Thereafter through the charging hole 7, a castable refractory material is introduced under pressure and vibration. The charged refractory material is cured, if necessary; and then fired after drying. Removal of the packing 3 after firing leaves a gap so that by further tightening of the bolt 12, the integrated catalyst 5 and its holder 6 are tightly fitted together, thereby completing the purifier.

Figure 3:
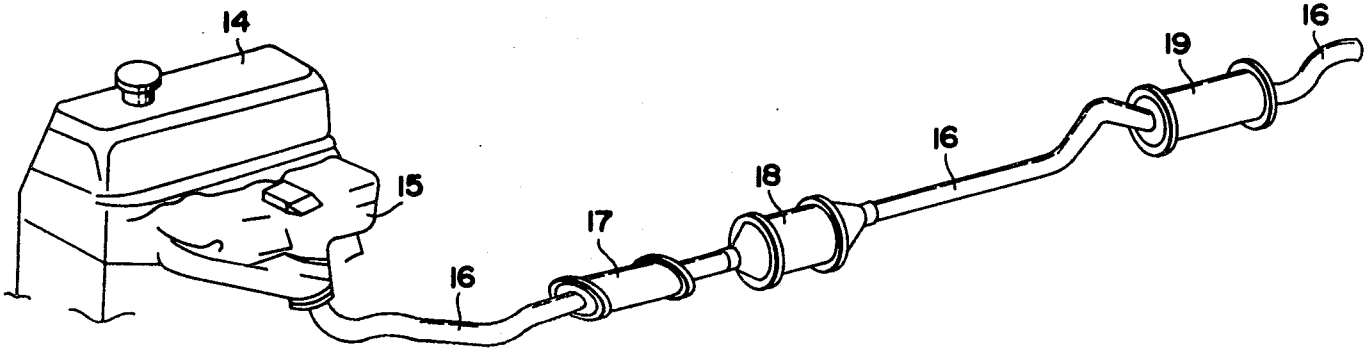
FIG. 3 shows the layout of an exhaust gas purifier according to the present invention, mounted on an automobile.

Referring now to FIG. 3, this shows a jig 9 for fitting the purifier to the exhaust pipe, together with flanges 10 and 11 with which the parts 1, 2 of the vessel are fitted together. The diameter of the centering plate 4 is equal to the diameter of the vessel when the parts 1, 2 are put together after removal of the packing 3.

It is one of the features in the present invention that, in assembling the vessel by putting together the divisible parts, a packing is inserted at the junction. Therefore the packing must have an appropriate thickness. As the packing which is to be removed after firing of the refractory material, a material like metal which is not eliminated by burning may be used; but it is more efficient, if a material which is eliminated in the process of firing is employed.

As the integrated catalyst, either an alumina carrier or a cordierite carrier of honeycomb structure may be used for the present invention.

As the castable refractory material, castable alumina or castable fused quartz is suitable, but it goes without saying that these are not the only materials which may be used.

The castable refractory material, which is elastic to some extent, will be able to increase the vibration resistance remarkably without damaging the integrated catalyst even when it is tightened, if according to the present invention, an appropriate shrink-fit allowance is provided.

In the catalyst converter according to the present invention, even if the rate of thermal expansion is nearly the same between the honeycomb catalyst and the castable refractory and that of the vessel is higher than those of catalyst and refractory, slight tightening will suffice to eliminate any gap between the refractory and the vessel when the refractory is uniformly provided and the vibration resistance will be improved, because the temperature distribution is usually such that for 700° – 900°C in the honeycomb catalyst, the castable refractory layer is at 700° – 300°C and the vessel is at 300° – 200°C.

Now some representative embodiments of the present invention will be illustrated.

EXAMPLE 1

As carrier for the integrated catalyst, a mixture of fused quartz powder less than 1 mm in particle size (92.5% $SiO_2$, 0.2% $Al_2O_3$, 0.2% $Fe_2O_3$, balance $K_2O$, $M_gO$) and 33% alumina cement less than 200 mesh (80% $Al_2O_3$, 0.2% $Fe_2O_3$, 19.5% CaO, 0.1% $SiO_2$, balance impurities) was adopted. 22 parts of water were added to 100 parts of this fused quartz castable powder, yielding a paste. The paste was charged into the hole 7 under pressure and vibration; cured at the room temperature for 15 hours; dried for one hour; and then fired at 700°C for one hour. After firing, the integrated catalyst and its holder were shrink-fitted together by tightening the bolt, thereby completing the purifier.

The inner diameter of the vessel was 98 mm. A sheet of paper 0.5 mm thick was used for packing. The catalyst was a honeycomb of platinum carried by cordierite with an outer diameter of 84 mm.

In the following examples, unless otherwise specified, the same vessel and the same catalyst were used.

The catalyst type exhaust gas purifiers thus obtained were placed on the vibrating table of a vibration testing machine and submitted to 50 hours each of endurance testing under vertical and horizontal vibrations whereby it was exposed to vibrations having a frequency of 90 Hz and an acceleration of 45G, while the catalyst was heated at 900°C for 10 minutes by a gas burner and then forcibly air-cooled to 70° – 100°C in 10 minutes, this cycle of heating and cooling being repeated. The results showed nothing wrong with the purifier.

Reference 1

A catalyst type exhaust gas purifier was manufactured without the packing 3 used in Example 1. In the same way as in Example 1, this purifier was submitted to vibration having a frequency of 90 Hz and an acceleration of 45G. Under vertical vibration it broke in 14 minutes, and under horizontal vibration in 30 seconds.

EXAMPLE 2

As the carrier of the integrated catalyst, a mixture of alumina powder of less than 1.5 mm in particle size (98% $Al_2O_3$, 1% $SiO_2$, 0.2% $Fe_2O_3$, balance $Na_2O$, $M_gO$) and alumina cement of less than 200 mesh (77% $Al_2O_3$, 21% CaO, 0.4% $SiO_2$, 0.5% $Fe_2O_3$, balance impurities) with ratio of 1l alumina to 600g cement was employed. 14 parts of water were added to 100 parts of this alumina castable parts, yielding a paste. The paste was charged through the hole 7 under pressure and vibration; cured for five hours at the room temperature; dried at 100°C for one hour; and then fired at 700°C for one hour. In this case the packing 3 was a sheet of paper 1.0 mm thick. After firing, the integrated catalyst 5 and its holder 6 were shrink-fit together by tightening the bolt to complete the purifier.

In the same way as in Example 1, the purifier was submitted to 50 hours each of horizontal and vertical vibrations (frequency 90 Hz, acceleration 45G) and nothing wrong was noted with it after the test.

Reference 2

In the test under vibrations (frequency 90 Hz, acceleration 45G), a purifier manufactured without the use of paper packing as in Example 2 broke in 10 seconds under horizontal vibration and in 12 minutes under vertical vibration.

EXAMPLE 3

As the carrier for the integrated catalyst, a mixture containing 30% foamed perlite less than 1 mm in size and 70% of a 50% aqueous solution of monoaluminum phosphate was employed. This mixture was charged into the hole 7 under vibration and pressure; dried at 250°C for 30 minutes; and then fired at 700°C for 30 minutes. After firing, the integrated catalyst 5 and its holder 6 were shrink-fit together by tightening the bolt to complete the purifier. The packing 3 was a piece of nylon film 1 mm thick.

The resulting purifier was subjected to 50 hours each of horizontal and vertical vibrations (frequency 90 Hz, acceleration 45G), without any substantial deterioration.

Reference 3

In vibration tests (frequency 90 Hz, acceleration 45G) a purifier with the integrated catalyst was held without use of the packing of Example 3, broke in 5 minutes under horizontal vibration and in 32 minutes under vertical vibration.

EXAMPLE 4

The purifier manufactured according to the present invention was mounted as shown in FIG. 3 on an automobile, which was then run for 30,000 Km as an endurance test, but no damage to the catalyst occurred. As illustrated in FIG. 3, reference numeral 14 indicates the engine, 15 the manifold, 16 the exhaust pipe, 17 the sub-muffler, 18 the purifier according to the present invention and 19 the main muffler. The purifier is one described in Example 1.

EXAMPLE 5

Instead of paper packing as in Example 1, stainless steel packing 0.5 mm thick was employed. After firing, the stainless steel packing was removed and the bolt was tightened to complete the purifier.

The anti-vibration characteristics of the purifier thus manufactured were the same as in Example 1.

The advantages of the exhaust gas purifier manufactured according to the present invention are as follows.

Since the integrated catalyst 5 and the vessel are shrink-fit together with the holder 6 in between, no gap develops between the vessel and the catalyst, even under vibration at high temperatures and accordingly the catalyst is not broken. The holder serves at the same time as a heat insulator. The outer dimensions of the integrated catalyst need not be so precise, because the catalyst is not directly heat-shrunk into the vessel; and the material of the holder is less expensive and more resistant to high temperature than metal textile.

What is claimed is:

1. Method of manufacturing a catalyst type exhaust gas purifier, which method comprises the steps of:

placing one side of the catalyst near the inner surface of one part of a divisible vessel;

positioning the other part of said divisible vessel near the opposite side of said catalyst while inserting packing means between said parts which keeps said parts separated;

said catalyst being smaller than said vessel so that a space is also left between said vessel and catalyst;

charging a castable refractory into the space between said vessel and catalyst;

solidifying and firing the refractory; and removing said packing and tightening the two parts of said vessel to compress said refractory, which has some elasticity, against said catalyst.

2. Method of manufacturing a catalyst type exhaust gas purifier as claimed in claim 1, wherein the packing is made of a material which is removed by the firing process.

3. Method of manufacturing a catalyst type exhaust gas purifier as claimed in claim 1, wherein the packing is made of a material which remains after the firing process and is then removed.

4. Method of manufacturing a catalyst type exhaust gas purifier as claimed in claim 1, wherein the catalyst is mounted on a centering plate within the vessel.

* * * * *